US010281139B2

(12) United States Patent
Kim

(10) Patent No.: US 10,281,139 B2
(45) Date of Patent: May 7, 2019

(54) HOT WATER BOILER

(71) Applicant: Junggon Kim, Seoul (KR)

(72) Inventor: Junggon Kim, Seoul (KR)

( * ) Notice: Subject to any disclaimer, the term of this patent is extended or adjusted under 35 U.S.C. 154(b) by 0 days.

(21) Appl. No.: 15/545,501

(22) PCT Filed: Jan. 8, 2016

(86) PCT No.: PCT/KR2016/000169
§ 371 (c)(1),
(2) Date: Jul. 21, 2017

(87) PCT Pub. No.: WO2016/117862
PCT Pub. Date: Jul. 28, 2016

(65) Prior Publication Data

US 2018/0010787 A1 Jan. 11, 2018

(30) Foreign Application Priority Data

Jan. 21, 2015 (KR) ..... 10-2015-0009658

(51) Int. Cl.
*F22B 11/00* (2006.01)
*F22B 11/02* (2006.01)
*F24H 1/28* (2006.01)

(52) U.S. Cl.
CPC ..... *F22B 11/02* (2013.01); *F24H 1/28* (2013.01)

(58) Field of Classification Search
CPC .. F24H 1/28; F22B 25/00; F22B 33/08; F22B 7/12; F22B 11/00; F22B 11/02
See application file for complete search history.

(56) References Cited

U.S. PATENT DOCUMENTS 3,747,670 A * 7/1973 Palm ..... F24H 1/26 165/142
3,885,125 A 5/1975 Palm et al.
(Continued)

FOREIGN PATENT DOCUMENTS

KR 10-1986-0007517 10/1986
KR 20-1988-0001069 2/1988

OTHER PUBLICATIONS

Apr. 19, 2016—International Search Report—Intl App PCT/KR2016/000169—Eng Tran.
(Continued)

*Primary Examiner* — Gregory A Wilson
(74) *Attorney, Agent, or Firm* — Banner & Witcoff, Ltd.

(57) ABSTRACT

The present invention relates to a hot water boiler. According to one aspect of the present invention, provided is a hot water boiler comprising: a water tube unit, which includes a combustion chamber in which combustion gas is generated, at least one water tube provided in the combustion chamber, and an outlet supplying hot water to a place needing hot water, which flows through the water tubes and is heated by absorbing heat from the combustion gas; a smoke tube unit including a main body, at least one smoke tube provided in the main body and vertically extended so as to allow the combustion gas to pass therethrough, an inner chamber encompassing the smoke tubes, and a supply passage supplying cold water, which is supplied from the outside, to an inner space of the inner chamber, wherein the inner chamber is configured so as to allow water flowing into the inner space of the inner chamber to be heated by absorbing the heat from the smoke tubes, and then to move to an outer space of the inner chamber from the upper part of the inner chamber; and a connection unit including a connection chamber supplying, to the smoke tube unit, the combustion gas provided from the water tube unit, and at least one
(Continued)

connection water tube supplying, to the water tube unit, the water provided from the smoke tube unit.

9 Claims, 6 Drawing Sheets

(56) References Cited

U.S. PATENT DOCUMENTS 3,918,410 A * 11/1975 Backman ..... F22B 25/00 122/271
4,123,995 A 11/1978 Ek
4,170,963 A * 10/1979 Siegrist ..... F24H 1/50 122/33
4,171,685 A 10/1979 Ek
5,197,415 A * 3/1993 Stretch ..... F23C 3/004 122/14.22
7,559,293 B2 * 7/2009 Gordon ..... F24H 1/205 122/13.01
7,900,589 B2 * 3/2011 Gordon ..... F24H 1/205 122/155.1
8,784,096 B2 * 7/2014 Mosiewicz ..... F23C 5/08 431/116
9,429,337 B2 * 8/2016 Lannes ..... F24H 1/205
9,546,798 B2 * 1/2017 Deivasigamani ..... F24H 1/145
2012/0291719 A1 * 11/2012 Steinhafel ..... F24H 1/00 122/18.3
2016/0370030 A1 * 12/2016 Zala ..... F24H 1/205

OTHER PUBLICATIONS

Apr. 19, 2016—Written Opinion—Intl App PCT/KR2016/000169—Eng Tran.

* cited by examiner

HOT WATER BOILER

CROSS REFERENCE TO RELATED APPLICATIONS

This is a U.S. National Phase Application under 35 U.S.C. § 371 of International Application No. PCT/KR2016/000169, filed Jan. 8, 2016, which claims priority to Korean Application No. 10-2015-0009658, filed Jan. 21, 2015, the entire contents of which are incorporated herein by reference.

TECHNICAL FIELD

The present invention relates to a hot water boiler, and more particularly, to a combined hot water boiler combining a water tube-type boiler and a smoke tube type boiler.

BACKGROUND

Hot water boilers are devices that supply water by heating and may be divided into domestic and industrial types according to the purpose of use. Generally, industrial boilers may be used in industrial facilities such as factories and large-scale residential facilities. Accordingly, such industrial boilers are required to supply high-temperature hot water or steam in large quantities, and thus, they are required to have high capacity and high efficiency.

Such large capacity hot water boilers may be divided into a water tube type boiler in which water flowing along a plurality of water tubes connecting vertically arranged headers absorbs heat from gas burned by a burner to become hot water; a smoke tube type boiler in which water contained in a main body forming a water tank absorbs heat from combustion gas passing through a plurality of smoke tubes passing through the inside of the main body to become hot water; and a combined boiler combining the water tube type boiler and smoke tube type boiler, according to the hot water production methods. Among these, the combined boiler has both the characteristics of the water tube boiler and the smoke tube type boiler and exhibits an advantage of excellent thermal efficiency.

The combined boilers are used to heat large residential facilities in some district heating energy facilities in Korea.

FIG. 1 shows a partial cross-sectional view schematically showing a conventional combined hot water boiler.

Referring to FIG. 1, the conventional combined hot water boiler may include a water tube unit 1 and a smoke tube unit 2 arranged side by side, and a connection unit 3 connecting them at the bottom of the water tube unit 1 and the smoke tube unit 2. Here, the connection unit 3 allows the water tube unit 1 and the smoke tube unit 2 to communicate with each other.

The water tube unit 1 may include an upper header 1*a*, a lower header 1*e*, a combustion chamber 1*c* disposed between the upper header 1*a* and the lower header 1*e*, and a plurality of water tubes 1*b* which connects the upper header 1*a* and the lower header 1*e* and is provided in the combustion chamber 1*c*. A burner 4 installed on the upper header 1*a* may generate a flame downward toward the combustion chamber 1*c* provided with the water tubes 1*b*, and the combustion gas thus generated may be moved to the smoke tube unit 2 through a post-combustion chamber 3*c* of the connection unit 3. The combustion gas transferred to the smoke tube unit 2 heats cold water (circulation water) supplied into a main body 2*a* of the smoke tube unit 2 while moving upward along a plurality of smoke tubes 2*b* extending in the longitudinal direction in the main body 2*a* and is then discharged to an exhaust duct 5 provided at an upper part of the main body 2*a*.

The circulation water heated by the combustion gas in the main body 2*a* of the smoke tube unit 2 is further heated by sequentially passing through a plurality of connecting water tubes 3*b* connected to the bottom 2*c* of the main body 2, a header 3*a* of the connection unit 3 and the water tubes 1*b* of the water tube unit 1, and the further heated water is then supplied to a place needing the hot water through an outlet 1*d* provided at the upper header 1*a* of the water tube unit 1. Accordingly, the high efficiency of the boiler may be achieved by such hot water supply method.

The combined hot water boiler, as shown in FIG. 1, may be referred to as a stand type hot water boiler with a combined water tube/smoke tube since the water tubes 1*b* and the smoke tubes 2*b* are formed by extending in a longitudinal direction, that is, in the direction of gravity.

However, in the conventional combined hot water boilers, since after discharged through the outlet 1*d* and circulated through a predetermined path, the cold water returning into the main body 2*a* of the smoke tube unit 2 through the circulation water port 2*d* is discharged near the top of the smoke tube 2*b* for effective heat exchange, the following problems may entail.

First, since the heated water in the main body 2*a* of the smoke tube unit 2, particularly the water heated from the lower side, is transferred to the upper part by convection, a flowing collision phenomenon occurs between the cold water flowing through the circulation water port 2*d* and the heated water moving to the upper part. Therefore, the cold water flowing through the circulation water port 2*d* cannot move smoothly to the lower side of the main body 2*a*. In addition, since there is a phenomenon in which the heated water is stagnated at the central portion of the main body 2*a* and thus relatively less heated water is positioned at the edge portion of the main body 2*a* in which the connecting water tubes 3*b* are arranged. As a result, the cold water flowing into the main body 2*a* is not heated sufficiently but is supplied to the connecting water tube 3*b* and the water tube 1*b*. Accordingly, this not only lowers the thermal efficiency of the boiler, but also affects the reliability of the heating system using these boilers.

In addition, due to the above phenomenon, heat exchange cannot be performed smoothly at the lower junction of the smoke tube 2*b* into which the combustion gas of high temperature is introduced. Therefore, the damage around the smoke tube 2*b* frequently occurs due to severe thermal shock. Specifically, the temperature of the combustion gas generated in the burner 4 is about 1,100 degrees Celsius. Since however the cold water introduced into the main body 2*a* cannot smoothly move to the lower portion of the main body 2*a*, the heat transfer from the combustion gas to the cold water is not performed sufficiently. As a result, a large thermal load is applied to the bottom portion of the main body 2*a*, that is, the bottom portion of the smoke tube 2*b* and the bottom portion 2*c* of the main body 2*a*.

As shown in FIG. 2, since the smoke tube 2*b* is jointed to the bottom 2*c* of the main body 2*a* by welding, the joint portion is relatively weaker than the other parts. As described above, if the thermal load is continuously applied to the joint portion of the smoke tube 2*b* and the bottom 2*c* of the main body 2*a*, cracks can easily occur on the joint portion. If such cracks occur continuously during the operation of the boiler, the joint portion is damaged, and as a result, water in the main body 2*a* of the smoke tube unit 2 may leak, as shown in FIG. 3. If it is left unattended, it may be a serious threat to the safety of the boiler. Therefore, there are problems that maintenance work such as replacing the smoke tube 2*b* is inevitable, the maintenance cost of the boiler is excessively high, and the life of the boiler is shortened and its stability is not guaranteed.

SUMMARY

The present invention has been proposed in order to solve the above-described problems of the conventional art, and is to provide a hot water boiler which can reduce maintenance cost, increase life span, and operate stably.

In addition, the present invention is to provide a hot water boiler with improved thermal efficiency.

In accordance with an aspect of the present invention, there is provided a hot water boiler, which includes: a water tube unit, the water tube unit including a combustion chamber in which combustion gas is generated, at least one water tube provided in the combustion chamber, and an outlet supplying hot water to a place needing the hot water, which flows through the water tubes and is heated by absorbing heat from the combustion gas; a smoke tube unit, the smoke tube unit including a main body, at least one smoke tube provided in the main body and vertically extended so as to allow the combustion gas to pass therethrough, an inner chamber encompassing the smoke tubes, and a supply passage supplying cold water, which is supplied from the outside, to an inner space of the inner chamber, wherein the inner chamber is configured so as to allow water flowing into the inner space of the inner chamber to be heated by absorbing the heat from the smoke tubes and then to be moved to an outer space of the inner chamber from the upper part of the inner chamber; and a connection unit, the connection unit including a connection chamber for supplying, to the smoke tube unit, the combustion gas provided from the water tube unit, and at least one connection water tube for supplying, to the water tube unit, the water provided from the smoke tube unit.

The aspect is directed to the hot water boiler, wherein one side of the water tube unit is provided with a burner for generating the combustion gas in the combustion chamber, and one side of the smoke tube unit is provided with an exhaust duct for exhausting combustion gas discharged from the smoke tube.

The aspect is directed to the hot water boiler, wherein the supply passage is connected to a lower portion of the inner chamber to discharge cold water to the lower portion of an inner space of the inner chamber The aspect is directed to the hot water boiler, wherein the upper end of the inner chamber is spaced apart from an upper surface of the main body or provided with a communication hole so that water in the inner space can be moved to the outer space.

The aspect is directed to the hot water boiler, wherein the connection water tube is connected to the lower surface of the main body so as to be communicated with an outer space of the inner chamber.

The aspect is directed to the hot water boiler, wherein the connection chamber is a post-combustion chamber, and the connection water tube is disposed in the connection chamber so that water supplied from the smoke tube unit can be heated and then supplied to the water tube unit.

The aspect is directed to the hot water boiler, wherein the supply passage is installed in the tangential direction of the inner chamber to guide the supplied water to be flowed into the upper part while rotating inside the inner chamber.

The aspect is directed to the hot water boiler, wherein the inner space is provided with a guide vane for guiding water so that water discharged from the supply passage can be moved by a predetermined distance without bumping into the smoke tube.

The aspect is directed to the hot water boiler, wherein the supply passage has an extended portion extending to the inner space, and the extended portion is formed with a plurality of discharge ports.

The aspect is directed to the hot water boiler, wherein the extended portion is formed in a '+' shape, and the smoke tube is disposed in an empty space of the extended portion.

The aspect is directed to the hot water boiler, which further includes an intermediate cylinder that is provided in a space between the inner chamber and the main body to provide a buffer space into which water supplied through the supply passage flows, wherein the inner chamber is formed with a plurality of inlet holes so that water in the buffer space can be introduced into the inner space.

The aspect is directed to the hot water boiler, wherein the intermediate cylinder has one end portion connected to the lower surface of the main body and the other end portion connected to the outer surface of the inner chamber to form the buffer space.

According to the embodiments of the present invention as described above, it is possible to provide a hot water boiler in which the maintenance cost is reduced, the lifetime is increased, and stable operation is achieved.

In addition, a hot water boiler with improved thermal efficiency can be provided.

DETAILED DESCRIPTION

Hereinafter, specific embodiments of the present invention will be described in detail with reference to the drawings.

In addition, in the following description of the present invention, a detailed description of known functions and configurations incorporated herein will be omitted when considering that it may make the subject matter of the present invention rather unclear.

Figure 1:
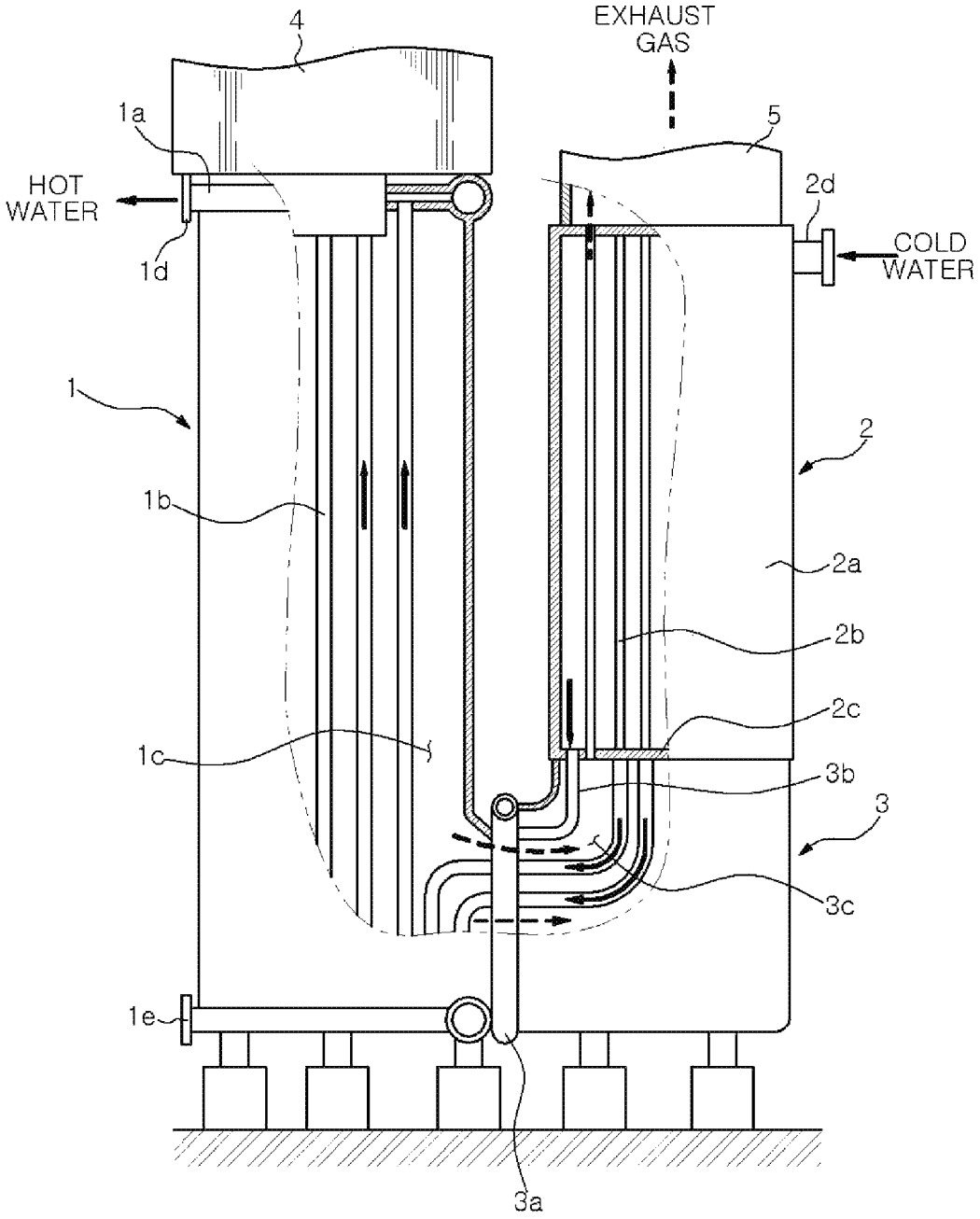
FIG. 1 RELATED ART
FIG. 1 is a partial cross-sectional view schematically illustrating a conventional combined hot water boiler.
Figure 2:
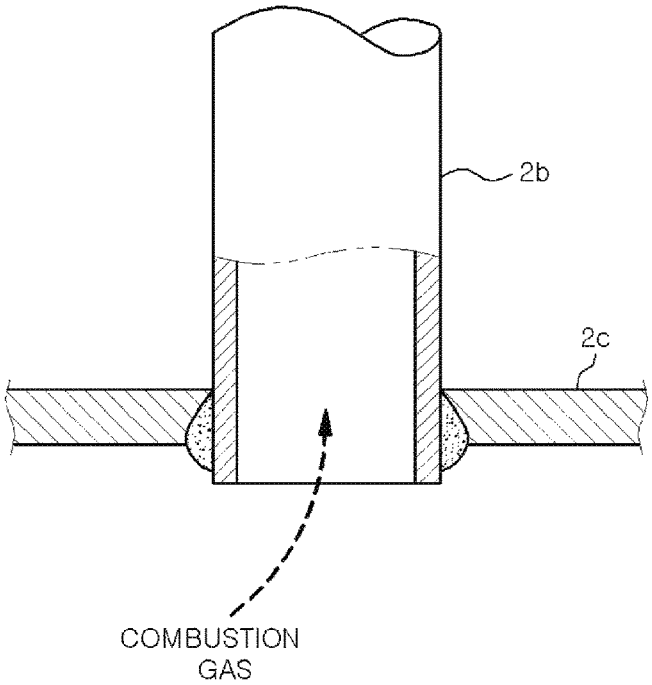
FIG. 2 is a partial cross-sectional view illustrating a smoke tube joint structure of FIG. 1.
Figure 3:
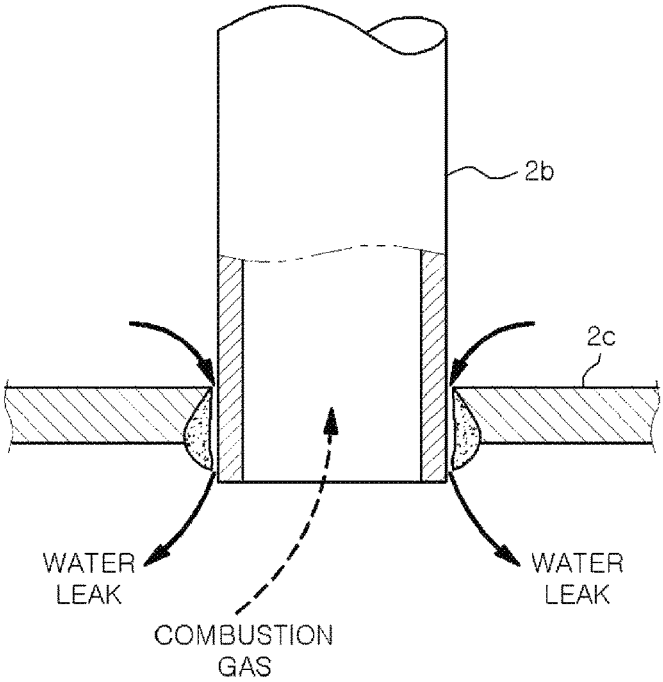
FIG. 3 is a partial cross-sectional view illustrating problems occurring in the smoke tube joint structure of FIG. 2.
Figure 4:
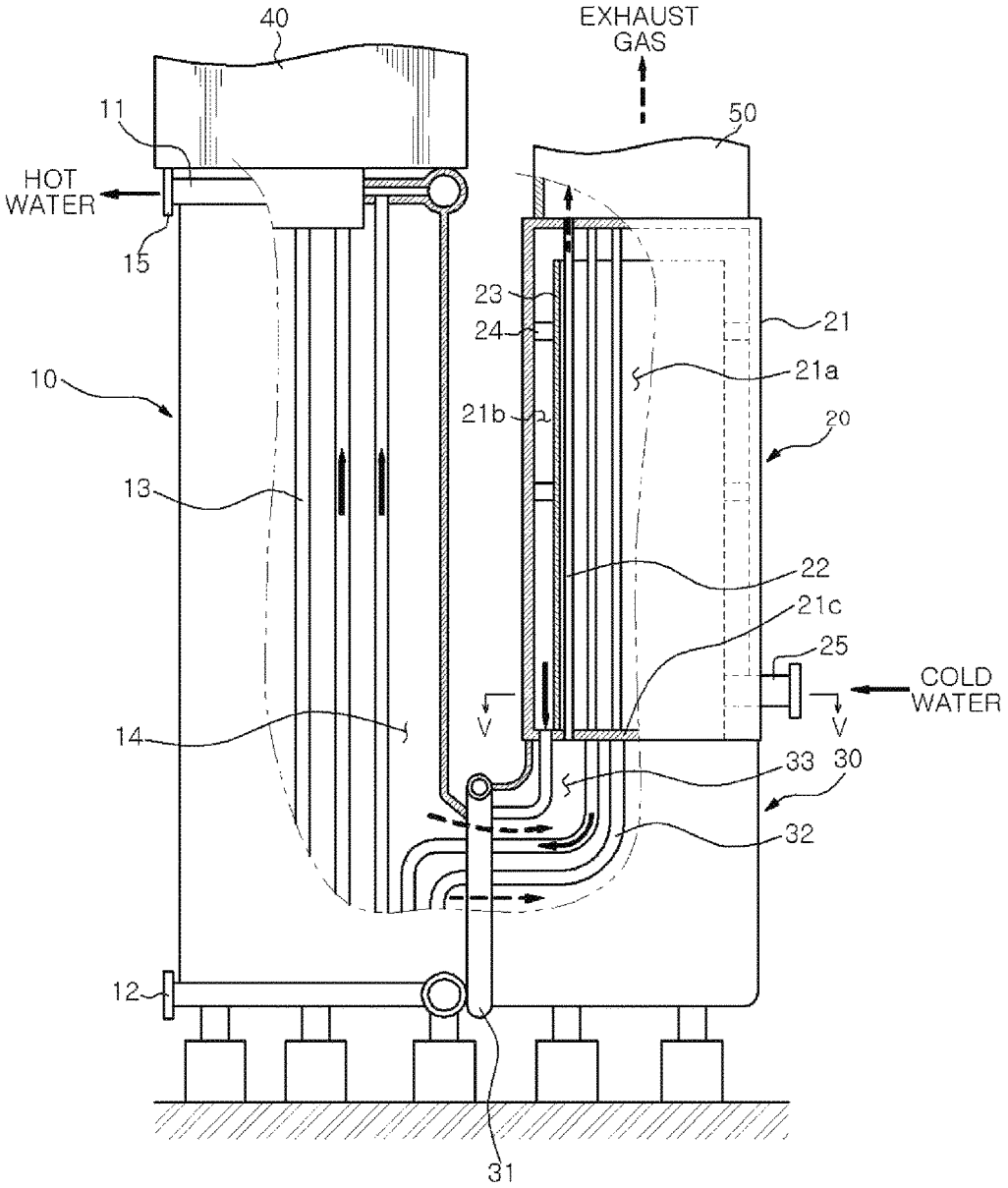
FIG. 4 is a partial cross-sectional view schematically illustrating a hot water boiler according to an embodiment of the present invention.
Figure 5:
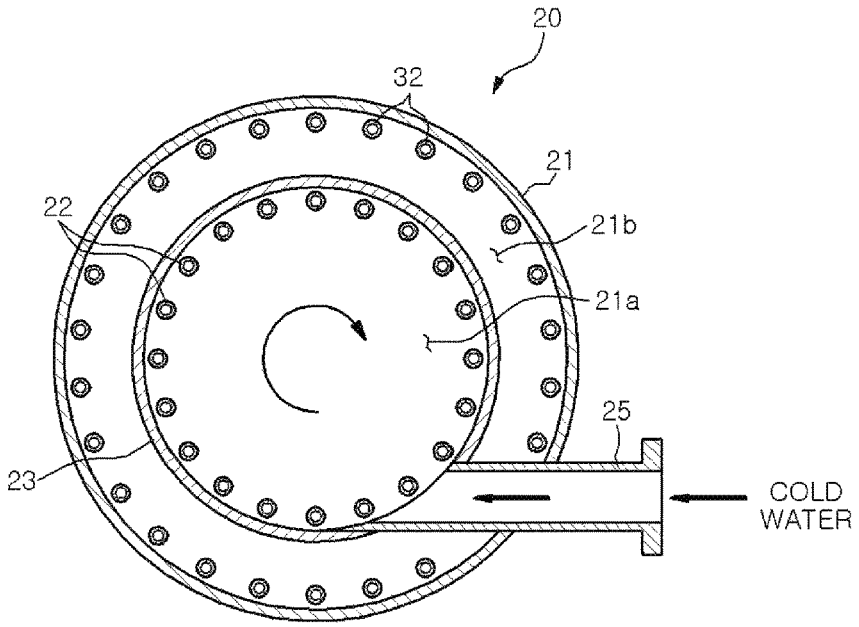
FIG. 5 is a cross-sectional view illustrating a state taken along a line V-V of FIG. 4.

FIG. 4 is a partial cross-sectional view schematically showing a hot water boiler according to an embodiment of the present invention, and FIG. 5 is a cross-sectional view illustrating a state taken along a line V-V of FIG. 4.

Referring to FIGS. 4 and 5, the hot water boiler according to an embodiment of the present invention may include a water tube unit 10 for heating water moving through at least one water tube 13 by combustion gas filled therein, a smoke tube unit 20 for heating water filled therein by the combustion gas moving through at least one or more smoke tubes 22, a connection unit 30 for connecting the water tube unit 10 and the smoke tube unit 20 to allow the combustion gas and the water to pass respectively therethrough, a burner 40 for generating the combustion gas, and an exhaust duct 50 for exhausting the combustion gas discharged from the smoke tube unit 20. In this embodiment, it will describe an example in which a plurality of water tubes 13 are provided.

The water tube unit 10 includes an upper header 11 and a lower header 12 spaced apart from each other in the vertical direction, and a combustion chamber 14 provided between the upper header 11 and the lower header 12 in which the combustion gas is formed by flame generated in the burner 40. The water tubes 13 extend vertically in the combustion chamber 14 to connect the upper header 11 and the lower header 12. In addition, the upper header 11 is provided with an outlet 15 for discharging heated hot water to a place needing the hot water.

In this embodiment, the water tubes 13 may be arranged to be spaced apart from each other by a predetermined distance in the horizontal direction within the combustion chamber 14. Further, the water tubes 13 may be bent in a predetermined shape at the center of the upper header 11 to form a hole for installing the burner 40. Meanwhile, one side of the bottom of the water tube unit 10 may be formed with a gas passage for guiding the combustion gas toward the connection chamber 33 of the connection unit 30 by bending the water tubes 13 as well.

This water tube unit 10 may be shielded from the outside by covering the outside thereof with an insulating cover.

On the other hand, the smoke tube unit 20 includes a main body 21 filled with cold water therein, an inner chamber 23 extending vertically inside the main body 21 to surround a portion of at least one or more smoke tubes 22 through which the combustion gas passes, and a supply passage 25 for supplying water into the main body 21.

The smoke tube 22 has its both ends which penetrate the upper surface and the lower surface 21*c* of the main body 21 such that they are connected by welding or the like to be communicated with the connection chamber 33 of the connection unit 30 and the exhaust duct 50, respectively.

The inner chamber 23 may be formed in a cylindrical shape upwardly extending from the lower surface 21*c* of the main body 21 by a predetermined length and the inner space of the main body 21 may be separated into the inner space 21*a* and the outer space 21*b* of the inner chamber 23, wherein the smoke tubes 22 are arranged in the inner space 21*a* of the inner chamber 23.

In the embodiment, the inner space 21*a* and the outer space 21*b* separated by the inner chamber 23 are communicated with each other at an upper portion of the main body 21. For this end, the upper portion of the inner chamber 23 may be formed with a communication hole, or an upper end of the inner chamber 23 may be spaced apart from the upper surface of the main body 21 by a predetermined distance. In the present embodiment, the latter case is shown as an example.

In addition, a plurality of brackets 24 for supporting the inner chamber 23 may be supported on the inner wall of the main body 21 around the inner chamber 23.

The supply passage 25 is to supply low-temperature water such as circulation water or cold water, which is returned after the hot water is used in the place needing the hot water, to the inside of the main body 21 and has one end exposed to the outside of the main body 21 to receive water and the other end connected to the inner chamber 23 to supply the water to the inner space 21*a* of the inner chamber 23. Specifically, the supply passage 25 is connected to the lower portion of the inner chamber 23 so that water can be discharged to the lower portion of the inner space of the inner chamber 23. That is, the water supplied from the outside is flowed into the lower portion of the inner space 21*a* of the inner chamber 23 through the supply passage 25.

In this embodiment, the supply passage 25 may be installed in the tangential direction of the transverse section of the inner chamber 23, as shown in FIG. 5. In this case, the water supplied to the inner space 21*a* of the inner chamber 23 may be heated while rotating along the inner wall of the inner chamber 23 to be smoothly moved to the upper part of the main body 21.

Meanwhile, the connection unit 30 may include a connection header 31 connected to the water tube unit 10, a connection chamber 33 through which the combustion gas discharged from the water tube unit 10 passes, and at least one or more connection water tubes 32 for transferring the water discharged from the smoke tube unit 20 to the water tube unit 10. Here, the connection chamber 33 may act as a post-combustion chamber.

The connection water tube 32 has one end which may be connected to the lower surface 21*c* of the main body 21 so as to be communicated with the outer space of the inner chamber 23 and the other end which may be connected to the header 31. In turn, the water in the outer space of the inner chamber 23 may be discharged from the main body 21 and transferred to the water tube unit 10.

The burner 40 is installed in the upper part of the water tube unit 10 to burn the fuel by forming a flame in the combustion chamber 14 downwardly, and the exhaust duct 50 is installed in the upper part of the main body 21 of the smoke tube unit 20 to exhaust the combustion gas that has passed through the plurality of smoke tubes 22 to the outside.

The operation and effect of the hot water boiler according to one embodiment of the present invention are as follows.

When the fuel is burned in the combustion chamber 14 of the water tube unit 10 by the burner 40, high-temperature combustion gas (for example, about 1,100 degrees Celsius) may be generated and the combustion gas generated in the combustion chamber 14 may be exhausted to the exhaust duct 50 by means of the smoke tube 22 of the smoke tube unit 20 through the connection chamber 33 of the connection unit 30.

The water supplied to the smoke tube unit 20 through the supply passage 25 is first heated in the smoke tube unit 20 and then further heated through the connection water tube 32 of the connection unit 30. In addition, the heated water is further heated through the water tube 13 of the water tube unit 10 to supply the hot water to the place needing the hot water through the outlet 15. The high-temperature hot water thus discharged may be circulated through a predetermined path, and then again supplied to the smoke tube unit 20 through the supply passage 25 in a state of a low-temperature.

Specifically, since the water supplied through the supply passage 25 is supplied to the inner space 21*a* of the inner chamber 23, it is supplied to the lower side of the smoke tube 22 through which the high-temperature combustion gas passes. The temperature of the water heat-exchanged with the combustion gas flowing through the smoke tube 22 rises and the water rises up to the upper part of the inner chamber 23 by convection. At this time, the inner space 21*a* of the inner chamber 23 is formed with a flow in which water is permitted to be upwardly moved as a whole by the water pressure and convection supplied through the supply passage 25. The water supplied through the supply passage 25 is smoothly moved upwardly and is heated during its movement by absorbing heat from the smoke tube 22.

The water moved to the upper side of the inner space 21*a* of the inner chamber 23 along with heating is moved to the outer space 21*b* of the inner chamber 23 through a space between the upper end of the inner chamber 23 and the upper surface of the main body 21, and moved downwardly through an outer space 21*b* of the inner chamber 23 to be discharged through the connection water tube 32. Since the water is heated to cause less convection in the outer space 21*b* of the inner chamber 23, such that the water can be moved smoothly and downwardly in the outer space 21*b* of the inner chamber 23.

As described above, the supply passage 25 supplies water to the lower portion of the inner space 21*a* of the inner chamber 23, so that the upward flow is formed in the inner space 21*a* of the inner chamber 23, and the downward flow is formed in the space 21*b* the inner chamber 23. Accordingly, the water may be smoothly flowed and heated without any flow collision between the cold water and the pre-heated hot water as in the conventional combined hot water boiler.

Moreover, in this embodiment, the supply passage 25 is installed in the tangential direction of the inner chamber 23. Accordingly, since the water to be circulated is heated while rotating in the inner space 21*a* of the inner chamber 23, not only the heat exchange is performed uniformly, but also the movement to the upper part may be performed very smoothly.

In this way, since the low-temperature water supplied through the supply passage 25 is supplied to the inner space of the inner chamber 23, particularly to the lower side of the smoke tube 22 into which the high-temperature combustion gas flows, it is possible to absorb heat from the combustion gas. In addition, since the water may flow continuously and smoothly without stagnation in the main body 21, the thermal load in the vicinity of the bottom joint portion of the smoke tube 22 may be effectively reduced. In particular, since this flow may be maintained while the boiler is running, even if the high-temperature combustion gas flows into the smoke tube 22 for a long time, the thermal load applied to the connection portion of the smoke tube 22 may be effectively reduced.

Accordingly, the problems caused by cracks in the joint portion of the smoke tube 22 generated in the conventional combined hot water boiler may be effectively prevented, and therefore the damage of the smoke tube 22 and the main body 21 may be prevented as much as possible, and the leakage of the smoke tube 22 may be prevented even when operated for a long period of time.

In addition, since the water circulated by the inner chamber 23 is sufficiently heated by the smoke tube 22 and naturally moves toward the connecting water tube 32, it is possible to prevent the problem in that the central portion of the main body 21 is sufficiently heated, but the edge portion is not sufficiently heated, as in the conventional art. Therefore, it is possible to prevent the problem in that the hot water may be supplied in a state in which the hot water is not sufficiently heated.

As a result, in the hot water boiler according to the present embodiment, the maintenance cost of the smoke tube 22 and the main body 21 may be reduced, and the lifetime thereof may be increased.

Further, since the operation failure that may be caused by the leakage of water generated at the connection portion of the smoke tube 22 may be prevented, there is an effect in that the operation may be performed stably.

Furthermore, since the water flows smoothly and the heat may be sufficiently exchanged with the smoke tube 22, it is possible to improve the overall thermal efficiency of the boiler.

Hereinafter, a hot water boiler according to another embodiment of the present invention will be described with reference to FIGS. 6 to 9. However, since the following embodiments are different from the above embodiments in the structure of the smoke tube unit 20 in comparison therebetween, the differences will be mainly described, and the same portions will use the descriptions and the reference numerals of the above embodiments.

Figure 6:
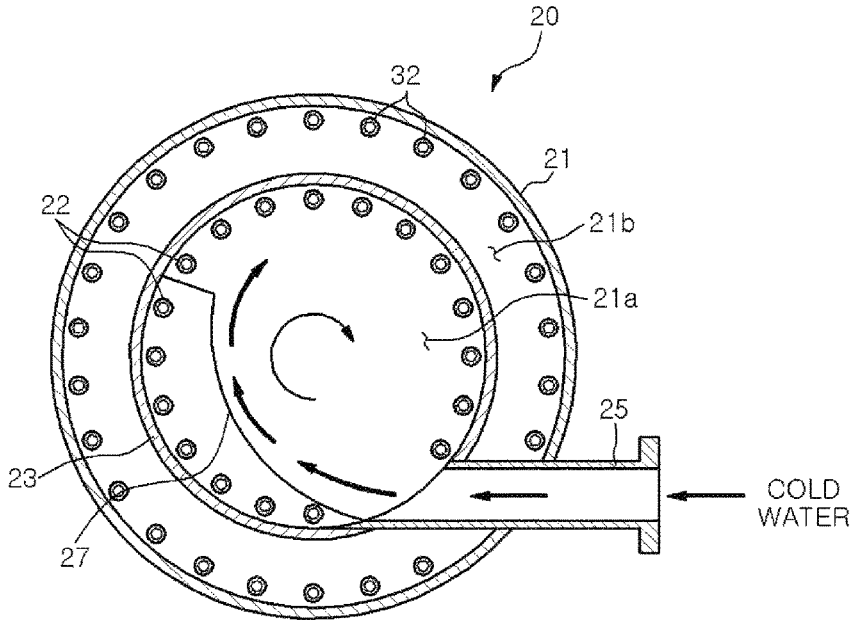
FIG. 6 is a cross-sectional view illustrating an inner portion of an inner chamber of a hot water boiler according to another embodiment of the present invention.

FIG. 6 is a cross-sectional view showing an inner portion of an inner chamber of a hot water boiler according to another embodiment of the present invention.

Referring to FIG. 6, in the hot water boiler according to another embodiment of the present invention, the inner space 21*a* of the inner chamber 23 may be provided with a guide vane 27 to allow the water discharged from the supply passage 25 to be discharged into the inner space 21*a* without directly bumping into the smoke tube 22.

The guide vane 27 is disposed adjacent to the outlet of the supply passage 25 and has the outer surface thereof formed in a shape corresponding to the inner surface of the inner chamber 23, so that the guide vane 27 can be tightly fixed to the inner chamber 23. The inner surface of the guide vane 27 has a curved shape with a predetermined curvature to guide the water so that the high-pressure water discharged through the discharge port of the supply passage 25 can meet with another smoke tube 22 after proceeding a certain distance without directly colliding with the smoke tube 22.

In addition, since the guide vane 27 is sufficient to guide the water discharged from the supply passage 25, it may be formed to have a height corresponding to the discharge port of the supply passage 25.

The hot water boiler provided with the guide vanes 27 has an effect of preventing the smoke tube 22 from being damaged by the continuous impact applied by the water continuously discharged at a high pressure through the supply passage 25. As a result, the service life of the hot water boiler may be further extended and the operation stability thereof may be improved.

Figure 7:
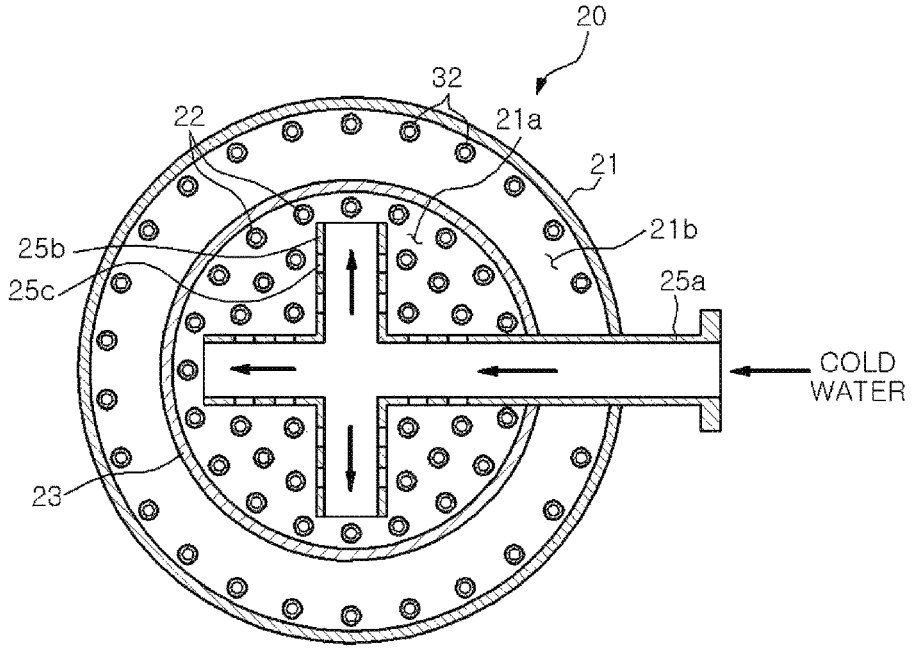
FIG. 7 is a cross-sectional view illustrating an inner portion of an inner chamber of a hot water boiler according to still another embodiment of the present invention.

FIG. 7 is a cross-sectional view showing an inner portion of an inner chamber of a hot water boiler according to still another embodiment of the present invention.

Referring to FIG. 7, the supply passage 25*a* of the hot water boiler according to another embodiment of the present invention has an extended portion 25*b* extending to the inner space of the inner chamber 23. The extension 25*b* may protrude from the inner surface of the inner chamber 23 and may be branched into a predetermined geometric shape. The extension portion 25*b* may be provided with a plurality of discharge ports 25*c* and the cold water supplied through the supply passage 25*a* may be discharged to the inner space 21*a* through the end of the extended portion 25*b* and/or the discharge port 25*c*. In this embodiment, the extended portion

25*b* is formed in a '+' shape, and water is discharged through the end portion of the extended portion 25*b* and the discharge port 25*c*, as shown in an example.

The smoke tube 22 may be disposed in an empty space of the inner space 21*a* according to the shape of the extended portion 25*b*.

As described above, since the hot water boiler has the supply passage 25*a* in which the extended portion 25*b* and the discharge port 25*c* are provided, the water may be discharged with a relatively low supply pressure. Accordingly, since the impact load applied to the smoke tube 22 may be reduced, there is an advantage in that the life of the smoke tube 22 may be increased.

In addition, since the cold water supplied from the outside is evenly spread and supplied in the inner space 21*a* of the inner chamber 23 and the smoke tube 22 is provided in the empty space of the inner space 21*a*, the heating of the cold water may be more effectively achieved.

Figure 8:
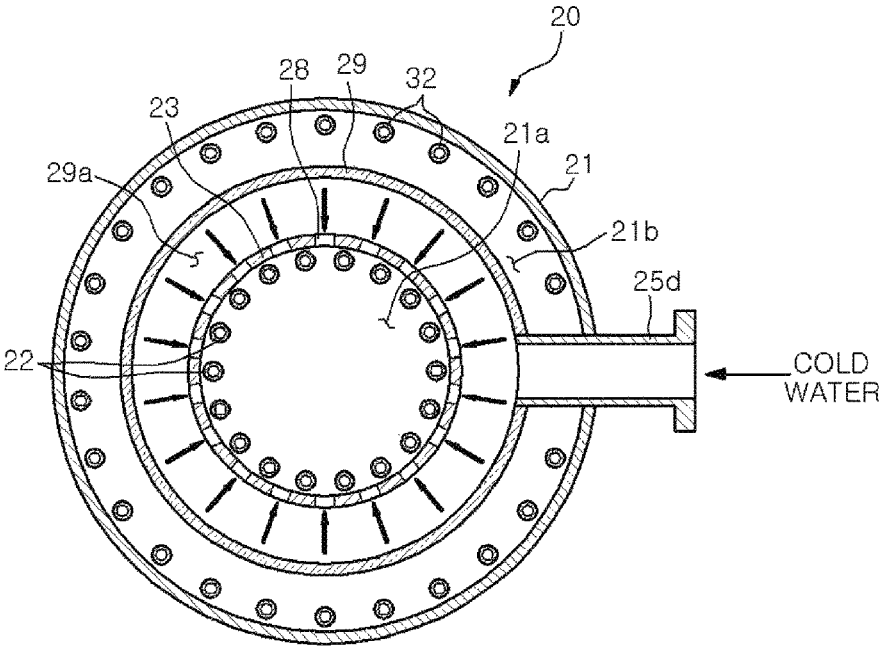
FIG. 8 is a cross-sectional view illustrating an inner portion of an inner chamber of a hot water boiler according to yet another embodiment of the present invention.
Figure 9:
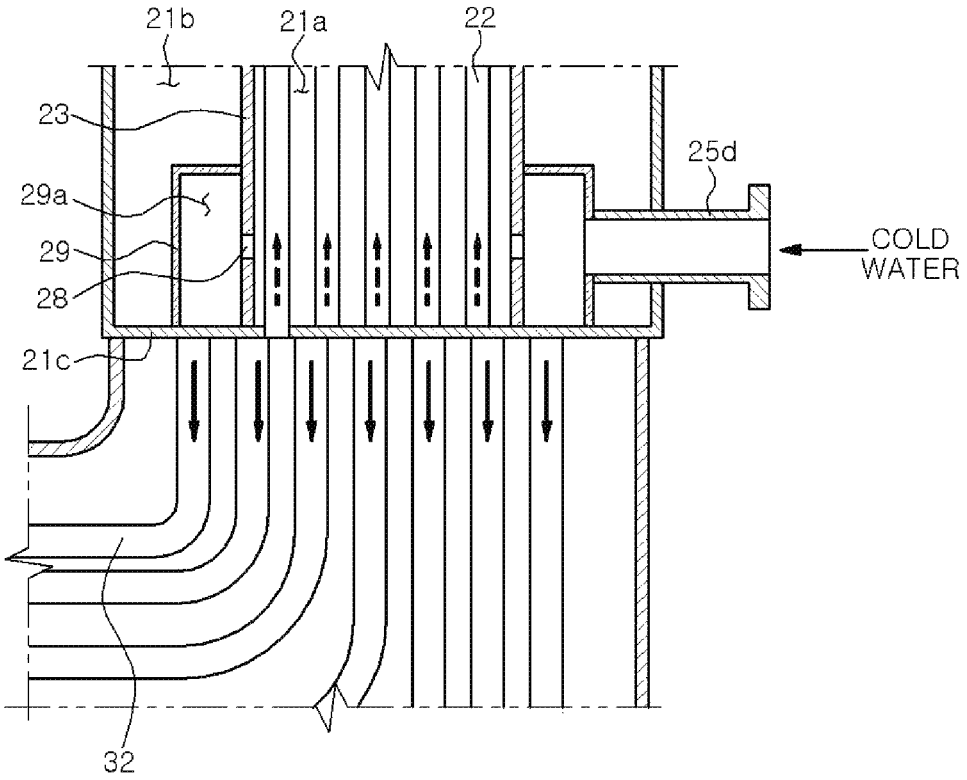
FIG. 9 is a cross-sectional view illustrating a part of an inner portion of the smoke tube unit of the hot water boiler of FIG. 8.

FIG. 8 is a cross-sectional view showing an inner portion of an inner chamber of a hot water boiler according to yet another embodiment of the present invention, and FIG. 9 is a cross-sectional view showing a part of an inner portion of the smoke tube unit of the hot water boiler of FIG. 9.

Referring to FIGS. 8 and 9, according to yet another embodiment of the present invention, an intermediate cylinder 29 may be provided between the inner chamber 23 and the main body 21 of the hot water boiler. The intermediate cylinder 29 may be provided to form a buffer space 29*a* into which the cold water supplied through the supply passage 25*d* is primarily introduced. The intermediate cylinder 29 may have one end portion connected to the lower surface 21*c* of the main body 21 and the other end portion connected to the outer surface of the inner chamber 23 to form the buffer space 29*a*. In addition, the supply passage 25*d* is connected to the intermediate cylinder 29 to discharge water toward the buffer space 29*a*. A plurality of inlet holes 28 may be formed in the inner chamber 23 so that the water introduced into the buffer space 29*a* flows into the inner space 21*a* of the inner chamber 23.

In this case, the smoke tube 22 may be disposed between the adjacent inlet holes 28 so that the water flowing into the inlet hole 28 does not directly collide.

As a result, in the case of the hot water boiler having the intermediate cylinder 29, since the water is firstly introduced into the buffer space 29*a* and then flows into the inner space 21*a* of the inner chamber 21*a* through the inlet hole 28, relatively low pressure water is discharged toward the smoke tube 22. Therefore, since the impact load applied to the smoke tube 22 may be reduced, there is an advantage in that the life of the smoke tube 22 may be increased.

Although the hot water boilers according to the embodiments of the present invention have been described above as specific embodiments, it is to be understood that the present invention is not limited thereto and should be construed as having the broadest scope according to the basic idea disclosed in the present specification. In addition, the embodiments disclosed herein may be combined or embodied with other patterns of shape that are not expressly recited herein, it should be noted that those skilled in the art will appreciate that they are also within the scope of the present invention. In addition, it will be apparent to those skilled in the art that various changes and modifications may be readily made without departing from the spirit and scope of the invention as defined by the appended claims.

The hot water boiler according to embodiments of the present invention may be used in domestic and industrial hot water supply industries.

The invention claimed is:

1. A hot water boiler comprising:

a water tube unit, the water tube unit including a combustion chamber in which combustion gas is generated, at least one water tube provided in the combustion chamber, and an outlet supplying hot water to a place needing the hot water through the at least one water tube, the hot water being heated by absorbing heat from the combustion gas;

a smoke tube unit, the smoke tube unit including a main body, at least one smoke tube provided in the main body and vertically extended so as to allow the combustion gas to pass therethrough, an inner chamber encompassing the at least one smoke tube, and a supply passage supplying cold water to an inner space of the inner chamber, wherein the inner chamber is configured so as to allow water flowing into the inner space of the inner chamber to be heated by absorbing heat from the at least one smoke tube and then to be moved to an outer space of the inner chamber from an upper part of the inner chamber; and a connection unit, the connection unit including a connection chamber for supplying, to the smoke tube unit, the combustion gas provided from the water tube unit, and at least one connection water tube for supplying, to the water tube unit, water provided from the smoke tube unit.

2. The hot water boiler according to claim 1, wherein one side of the water tube unit is provided with a burner for generating the combustion gas in the combustion chamber, and wherein one side of the smoke tube unit is provided with an exhaust duct for exhausting combustion gas discharged from the at least one smoke tube.

3. The hot water boiler according to claim 1, wherein the supply passage is connected to a lower portion of the inner chamber to discharge cold water to a lower portion of the inner space of the inner chamber.

4. The hot water boiler according to claim 1, wherein an upper end of the inner chamber is spaced apart from an upper surface of the main body or provided with a communication hole so that water in the inner space can be moved to the outer space.

5. The hot water boiler according to claim 1, wherein the connection water tube is connected to a lower surface of the main body so as to be communicated with an outer space of the inner chamber.

6. The hot water boiler according to claim 1, wherein the connection chamber is a post-combustion chamber, and the connection water tube is disposed in the connection chamber so that water supplied from the smoke tube unit can be heated and then supplied to the water tube unit.

7. The hot water boiler according to claim 1, wherein the supply passage has an extended portion extending to the inner space, and the extended portion is formed with a plurality of discharge ports.

8. The hot water boiler according to claim 1, further comprising:

an intermediate cylinder that is provided in a space between the inner chamber and the main body to provide a buffer space into which water supplied through the supply passage flows and wherein the inner chamber is formed with a plurality of inlet holes so that water in the buffer space can be introduced into the inner space.

9. The hot water boiler according to claim 8, wherein the intermediate cylinder has one end portion connected to a lower surface of the main body and the other end portion connected to an outer surface of the inner chamber to form the buffer space.

* * * * *